US009054414B2

(12) United States Patent
Mizzoni et al.

(10) Patent No.: US 9,054,414 B2
(45) Date of Patent: Jun. 9, 2015

(54) ANTENNA SYSTEM FOR LOW-EARTH-ORBIT SATELLITES

(75) Inventors: Roberto Mizzoni, Rome (IT); Franco Perrini, Rome (IT); Paolo Noschese, Rome (IT); Marcello Zolesi, Rome (IT)

(73) Assignee: Thales Alenia Space Italia S.p.A. Con Unico Socio, Rome (IT)

( * ) Notice: Subject to any disclaimer, the term of this patent is extended or adjusted under 35 U.S.C. 154(b) by 290 days.

(21) Appl. No.: 13/361,146

(22) Filed: Jan. 30, 2012

(65) Prior Publication Data

US 2012/0242539 A1 Sep. 27, 2012

(30) Foreign Application Priority Data

Jan. 28, 2011 (IT) ..... TO2011A0074

(51) Int. Cl.

| | |
|---|---|
| ***H01Q 19/10*** | (2006.01) |
| ***H01Q 13/10*** | (2006.01) |
| ***H01Q 3/26*** | (2006.01) |
| ***H01Q 15/14*** | (2006.01) |
| ***H01Q 19/17*** | (2006.01) |
| ***H01Q 19/19*** | (2006.01) |

(52) U.S. Cl.

CPC ..... *H01Q 3/2658* (2013.01); *H01Q 3/2664* (2013.01); *H01Q 15/147* (2013.01); *H01Q 19/17* (2013.01); *H01Q 19/192* (2013.01)

(58) Field of Classification Search

CPC ..... H01Q 19/062; H01Q 19/06

See application file for complete search history.

(56) References Cited

U.S. PATENT DOCUMENTS

| | | | | |
|---|---|---|---|---|
| 4,586,051 | A * | 4/1986 | Saitto et al. | 343/703 |
| 4,740,791 | A * | 4/1988 | Darbowitch et al. | 342/368 |
| 4,827,277 | A * | 5/1989 | Becker et al. | 343/781 P |
| 4,855,826 | A * | 8/1989 | Wischermann et al. | 348/180 |
| 6,266,024 | B1 * | 7/2001 | Ramanujam et al. | 343/781 CA |
| 6,580,399 | B1 * | 6/2003 | Ballinger et al. | 343/781 P |

(Continued)

FOREIGN PATENT DOCUMENTS

| | | |
|---|---|---|
| EP | 0 683 541 A1 | 11/1995 |
| JP | 58 177006 A | 10/1983 |

OTHER PUBLICATIONS

Mizzoni R, et al. "Feed Systems for Array-Fed Reflector Scansar Antennas" IEEE 2009 3rd European Conference on Antennas and Propagation, Eucap, 2009, pp. 3060-3064, XP002659178, Piscataway, NJ.

Roth, H., et al. "Highly Shaped Satellite Antenna for Constant Flux Illumination of the Earth From Low Orbits", Proceedings of the 23rd European Microwave Conference, Madrid, Sep. 6-9, 1993 pp. 190-193.

(Continued)

*Primary Examiner* — Trinh Dinh

(74) *Attorney, Agent, or Firm* — McCarter & English, LLP

(57) ABSTRACT

The present invention regards an antenna system comprising a reflection system that comprises a reflector having a rotational symmetry with respect to an axis of symmetry. Moreover, the antenna system also comprises an electronically steerable planar radiating array that is arranged in a focal region of the reflection system, has a rotational symmetry with respect to the axis of symmetry and is operable to radiate a primary radiofrequency beam oriented in a predefined direction of illumination with respect to the axis of symmetry in such a way as to cause a specific region of the reflector to be illuminated by said primary radiofrequency beam. Said specific region of the reflector is designed, when illuminated by said primary radiofrequency beam, to generate by reflection a secondary radiofrequency beam oriented in at least one predefined direction of transmission with respect to the axis of symmetry.

18 Claims, 7 Drawing Sheets

(56) References Cited

U.S. PATENT DOCUMENTS

| | | | | |
|---|---|---|---|---|
| 6,842,157 | B2 * | 1/2005 | Phelan et al. | 343/893 |
| 6,943,745 | B2 * | 9/2005 | Rao et al. | 343/757 |
| 7,315,279 | B1 | 1/2008 | Milbourne | |
| 7,466,287 | B1 * | 12/2008 | Lam et al. | 343/895 |
| 2007/0115195 | A1 * | 5/2007 | Locatori | 343/781 CA |

OTHER PUBLICATIONS

F. J. Da Silva Moreira, et al., "Axis-Displaced Dual-Reflector Antennas for Omnidirectional Coverage with Arbitrary Main-Beam Direction in the Elevation Plane", IEEE Transactions on Antennas and Propagation, vol. 564, No. 10, Oct. 2006, pp. 2854-2861.

* cited by examiner

ANTENNA SYSTEM FOR LOW-EARTH-ORBIT SATELLITES

TECHNICAL FIELD OF THE INVENTION

In general, the present invention regards an antenna system for low-Earth-orbit (LEO) satellites.

In particular, the present invention regards a microwave antenna system that finds advantageous, but non-exclusive, application in so-called "Payload Data Handling and Transmission" (PDHT) systems used for transmitting data with a distribution of the effective isotropic radiated power (EIRP) that is constant all over the Earth.

STATE OF THE ART

As is known, LEO satellites are generally equipped with Earth-observation systems, such as synthetic-aperture radars (SARs) and/or optical instruments, and exploit, for transmission to the Earth of remotely-sensed data, microwave antennas with distribution of the effective isotropic radiated power (EIRP) that is constant all over the Earth. Typically LEO satellites orbit at a height from the Earth that varies between 400 and 800 km. Consequently, an antenna for transmission to the Earth of the data of a LEO satellite has a very wide field of view that can be defined by a cone centred with respect to the nadir axis of the antenna and having a half-angle of aperture in the region of 62°-70°. According, then, to the exact height of the LEO satellite, the on-board antenna, in order to be able to maintain an isoflux distribution of power on the Earth, must guarantee an increase in gain, between the nadir direction and the point tangential to the Earth's edge, typically comprised between 12 and 15 dB in order to compensate for the differential path losses due to the greater distance from the LEO satellite of a user located at the Earth's edge as compared to a user located in the nadir direction.

Currently, on LEO satellites shaped-beam fixed antennas with low-gain in the X-Band are used, which afford a quasi-hemispherical coverage (with approximately 65° of half-angle). The problems that can be encountered with this type of antennas are the low gain, limited to approximately 6 dBi at the edge of coverage, and a limited capacity of discrimination of the polarisation, which is not compatible with a re-use of the frequency.

As is known, future PDHT systems will have to guarantee a significant increase in the data-transmission rate. This increase in rate and amount of data transmitted can be obtained by:

- increasing the antenna gain via repointable directive beams, instead of fixed low-gain beams; and/or
- increasing the power transmitted; or else
- increasing the bandwidth, for example re-using the available spectrum through a re-use of the polarisation.

Consequently, in the light of what has been set forth previously, fixed-coverage antennas are not able to meet this requirement of increase in the data-transmission capacity. Currently, more directive antenna systems with mechanically or electronically repointable beam are consequently under study.

In this regard, however, it should be emphasized that in satellites equipped with optical Earth-observation systems it is fundamental to prevent possible micro-vibrations induced by mechanical-repointing antennas. Consequently, electronic-repointing antenna systems are favoured over mechanical-repointing ones.

These electronic-repointing antenna systems are based upon planar and/or conformal arrays of radiating elements supplied by variable phase shifters with power-distribution networks of an active, semi-active, and/or passive type. An example of direct planar-array antenna of an active type in the Ka-band is described by J. D. Warshowsky, J. J. Whelehan, R. L. Clouse, *High Rate User Phased Array Antenna for Small Leo Satellites*, Fourth Ka-Band Utilization Conference, Nov. 2-4, 1998, Venice, whilst an example of an active X-Band planar-array antenna can be found in *X-Band Phased Array Antenna Validation Report*, Mar. 1, 2002, by Kenneth Perko et al., NASA Goddard Space Flight Center, Greenbelt, Md. 20771. Planar arrays with electronic scanning of the beam require many radiating elements and have a limited repointing field, typically up to 60° in the direction normal to the planar array, namely, "boresight", the reason for this being the very high scanning losses tested also by adopting spacings reduced to 0.5λ of the array. Said antennas moreover require a large number of radiating elements in order to meet the demand for a much higher gain/EIRP at the edge of coverage in spite of the high losses suffered as compared to the nadir or antenna boresight since said antennas produce "naturally" in the boresight direction the maximum gain/EIRP. It hence happens that these antennas provide a relative variation of the gain from the nadir that has a behaviour exactly opposite to what is desirable for the service required.

Consequently, known direct planar-array antennas are not very suited to satellites that orbit at a height from the Earth lower than 1000 km.

Conformal-array antennas potentially remove these limitations. In the past, prototypes of conformal-array antennas have been developed of a semi-active type, with distributed amplification and based upon the use of Butler matrices, and of a passive type, with centralized amplification and variable phase shifters. In this regard, reference may be made, for example, to E. Vourch, G. Caille, M. J. Martin, J. R. Mosig, A. Martin, P. O. Iversen, *Conformal array antenna for LEO observation platforms*, IEEE Antennas and Propagation Society International Symposium, June 1998, vol. 1, pp. 20-23. Up to the present day, conformal-array antennas are still studied for X- and Ka-bands. However said conformal-array antennas do not seem to constitute effective solutions for the problem of data transmission from LEO satellites to Earth stations. In fact, in these antennas the number of radiating elements is comparable to or higher than that of a planar-array antenna but with the aggravating factor that the radiating elements of a conformal-array antenna cannot be arranged in a plane. The spacing of the radiating elements in these antennas must be compatible with the axial length of the elements themselves in order to prevent mechanical interference between them. This involves a non-minimal spacing and the possible onset of "grating lobes" or spurious beams at wide ranges of beam scanning. Even though the allocation of the elements can be partially solved by grouping the elements together into planar subsets or sub-arrays, it even so conditions to a large extent the complexity of the antenna on account of the power-supply network, which is typically compatible only with cables and with radiators with smaller axial encumbrance, for example of the patch type.

A further possible solution currently under study but far from mature is based upon the use of reflect-array antennas. In this regard, reference may be made, for example, to C. Apert, T. Koleck, P. Dumon, T. Dousset, C. Renard, *ERASP: A New Reflect Array Antenna for Space Applications*, EuCap, November 2006. The reflect-array antennas currently being studied are constituted by elements, for example waveguides or printed radiators, set in a triangular mesh on a plane surface and controllable via variable phase shifters integrated in the radiating elements, i.e., packaged, and based upon PIN (Positive-Intrinsic-Negative) diodes or on MEMS (Micro Electro-Mechanical Systems) membranes. The array is illuminated by an external illuminator, and the wave is appropriately re-phased after reflection by the array in such a way as to generate a scanning beam similar to that of the direct active planar arrays described previously.

Other solutions currently being studied are based upon segmentation of the service coverage and upon the use of a plurality of antennas, each designed to cover a respective specific angular sector. However, these solutions suffer not only from the problems described previously but also from the segmentation of the service as a function of the orbit of the satellite and of the position of the Earth station that must receive the data from the satellite.

Finally, it should also be emphasized that the transmission of data from LEO satellites to Earth stations must respect a further important requirement linked to the maximum power densities allowed on the Earth towards the Earth stations and, in particular, towards the so-called Deep Space Networks (DSNs), which constitute the infrastructures of satellite communications at a world level for interplanetary probes.

OBJECT AND SUMMARY OF THE INVENTION

The aim of the present invention is thus to provide an antenna system for LEO satellites that will enable alleviation, at least in part, of the disadvantages described previously and will enable the transmission requirements referred to previously to be met.

The aforesaid aim is achieved by the present invention in so far as it regards an antenna system for LEO satellites according to what is defined in the annexed claims.

BRIEF DESCRIPTION OF THE DRAWINGS

For a better understanding of the present invention, some preferred embodiments, provided purely by way of explanatory and non-limiting example, will now be illustrated with reference to the annexed drawings (not in scale), wherein.

DETAILED DESCRIPTION OF PREFERRED EMBODIMENTS OF THE INVENTION

The present invention will now be described in detail with reference to the attached figures to enable a person skilled in the sector to reproduce it and use it. Various modifications to the embodiments described will be immediately evident to persons skilled in the sector, and the generic principles described could be applied to other embodiments and applications, without thereby departing from the sphere of protection of the present invention, as defined in the annexed claims. Consequently, the present invention is not to be considered as being limited just to the embodiments described and illustrated herein, but it must be granted the widest sphere of protection in accordance with the principles and characteristics described and claimed herein.

The present invention regards a microwave antenna system for LEO satellites configured to produce, by using an optical system with single or double reflector and with rotational symmetry, an electronically scanned beam with one or two degrees of freedom, when appropriately illuminated by an electronically steerable planar radiating array. The characteristics of gain that can be obtained as a function of the distance from the nadir axis are such as to respect the gain mask required for guaranteeing an isoflux distribution of the power on the Earth. The antenna EIRP can adapt to different absolute values as the dimensions of the reflector/reflectors and/or the number of radiating elements of the electronically steerable planar radiating array and/or the power of transmission of the radiating elements themselves vary, whilst via appropriate shaping of the reflector/reflectors it is possible to direct the distribution of the power according to the desired law and to the distance of the satellite from the Earth.

In particular, the antenna system comprises an electronically steerable planar radiating array comprising radiating elements, or radiators, conveniently driven by phase shifters, and an antenna optics that comprises one or two reflectors with rotational symmetry, the profile of which is optimised in such a way as to distribute the power to the Earth with isoflux characteristics, i.e., with distribution of gain that compensates, as a function of the angle from the nadir, the different spatial attenuation of the satellite-Earth path. By changing the law of the phase shifters that drive the radiating elements, the antenna system is able to transmit an electronic beam rotating with respect to the nadir axis (repointing of the beam with one degree of freedom). Conveniently, repointing of the beam can be achieved also in elevation (repointing of the beam with two degrees of freedom).

The antenna system can be easily configured to obtain the peak of the beam in a typical range of values of from 54° to 90° in such a way that it can be used by LEO satellites that have a height from the Earth of from 0 to 1500 km approximately.

Figure 1:
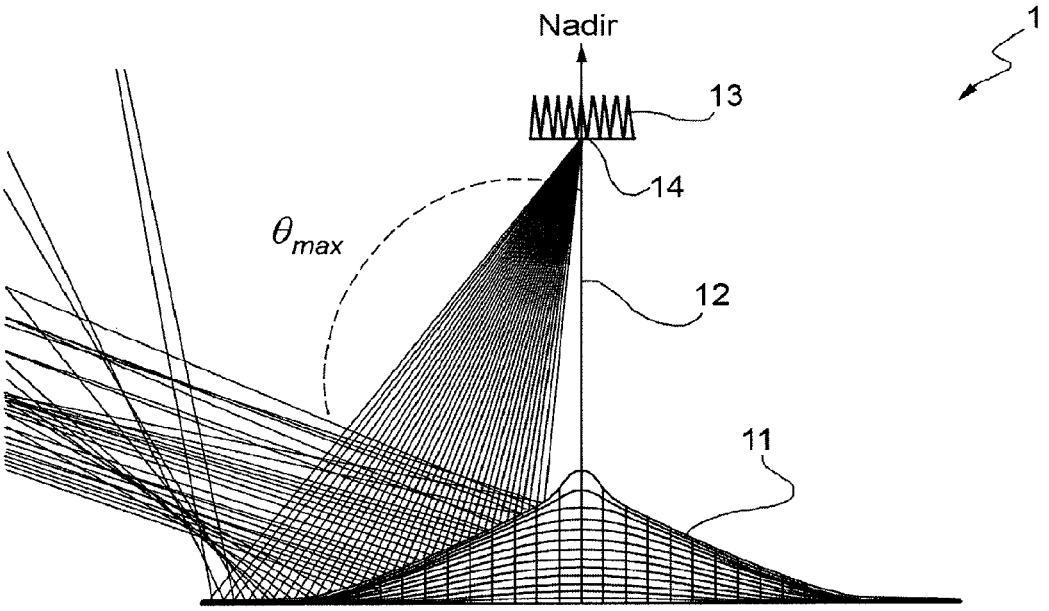
FIG. 1 is a schematic lateral sectional view of an antenna system according to a first preferred embodiment of the present invention, where also schematically shown is a tracing in geometrical optics of signals transmitted by the antenna system.

FIG. 1 is a schematic illustration of a cross section of an antenna system 1, obtained according to a first preferred embodiment of the present invention, together with a tracing in geometrical optics of signals transmitted by the antenna system 1.

In particular, as illustrated in FIG. 1, the antenna system 1, which is designed to be installed on a LEO satellite, comprises:

- a reflector 11 with rotational symmetry with respect to an axis of symmetry 12 that, in use, coincides with the nadir of the antenna system 1 installed on the LEO satellite (not illustrated in FIG. 1); and
- an electronically steerable planar radiating array 13 comprising radiating elements, or radiators, arranged in a focal plane of the reflector 11 and configured to illuminate the reflector 11 by radiating signals, conveniently having frequencies belonging to the X band and/or to the Ka-band, in such a way that the radiated signals propagate as far as the reflector 11 and are thus appropriately reflected by said reflector 11, as will be described in detail hereinafter.

In detail, since FIG. 1 represents a cross section of the antenna system 1, it shows the lateral profile of the reflector 11 with rotational symmetry after shaping, and the arrangement of the radiating elements with plane of aperture at a focus 14 of the reflector 11. In addition, FIG. 1 shows schematically also a tracing of the signals that, in use, are radiated by the radiators that can be arranged so as to form an equiangular mesh, or be arranged at equal distances apart along circumferences with increasing radius to obtain a complete rotational symmetry with respect to the axis of symmetry 12. As illustrated in FIG. 1, the signals radiated by the radiators are reflected by the reflector 11 in such a way that the energy of said signals is focused, in far field, prevalently in a direction identified by a predefined angle $\theta_{max}$ with respect to the axis of symmetry 12. Moreover, considering the structure of the antenna system 1 illustrated in FIG. 1 from a three-dimensional standpoint, we find that the signals radiated by the radiators are reflected by the reflector 11 in such a way that the energy of said signals is focused, in far field, at different levels of intensity in directions identified in space by the same predefined maximum angle of transmission $\theta_{max}$ with respect to the axis of symmetry 12.

Figure 2:
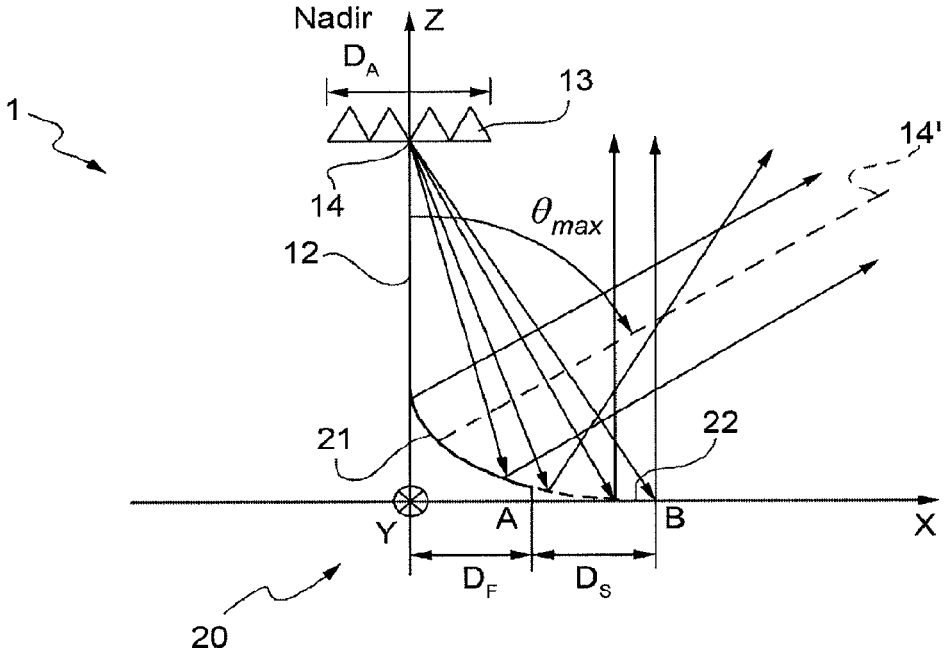
FIG. 2 is a schematic illustration of how a lateral profile of a reflector of the antenna system is defined according to the first preferred embodiment of the present invention.

More specifically, FIG. 2 is a schematic illustration of how the profile of the reflector 11 is defined analytically. In particular, also FIG. 2 is a lateral sectional view of the antenna system 1 during definition of the profile of the reflector 11, and in said figure elements that are the same as the ones already described and illustrated in FIG. 1 are identified by the same reference numbers.

In detail, with reference to the three-dimensional cartesian reference system XYZ illustrated in FIG. 2 and having the axis Z coinciding, in use, with the nadir of the antenna system 1 installed on the LEO satellite, i.e., with the axis of symmetry 12, the reflector 11 can be built by defining initially in the plane XZ an ellipse having a first focus in the point 14 in which the electronically steerable planar radiating array 13 is set and a second focus 14' that is very distant from the antenna system 1 in the direction identified by the predefined maximum angle of transmission $\theta_{max}$ and that corresponds to a predefined extreme point of the Earth that must be reached by the signals transmitted, in use, by the antenna system 1 installed on the LEO satellite.

Next, a first portion 21 of a template 20 used for obtaining the reflector 11 is shaped according to the ellipse defined. In particular, the first portion 21 of the template 20 extends in the plane XZ in accordance with the analytical behaviour of the ellipse defined; specifically, it extends laterally from the axis of symmetry 12 up to a first point A set at a first distance $D_F$, in the direction X, from the axis Z, i.e., from the axis of symmetry 12. Consequently, a first portion of the reflector 11 built on the basis of the first portion 21 of the template 20 is such as to focus a spherical wave radiated, in use, by the radiators positioned in the first focus 14 in the direction of transmission that is identified by the predefined maximum angle of transmission $\theta_{max}$ and that angularly corresponds to the peak of the isoflux diagram desired, in use, with respect to the nadir axis 12.

Once again with reference to FIG. 2, in a further subsequent step, a second portion 22 of the template 20, which extends laterally from the first portion 21, is shaped by modifying gradually the radius of curvature of the first portion 21 in such a way that, in use, the signals radiated by the radiators that are reflected by a second portion of the reflector 11 obtained on the basis of the second portion 22 of the template will be directed, in accordance with the laws of geometrical optics or else of physical optics, in directions of transmission identified by angles with respect to the axis of symmetry 12 that are comprised between 0° and $\theta_{max}$. In other words, the first portion 21 of the template 20 is radiused with the second portion 22, which gradually modifies the radius of curvature of the template 20 until it is obtained that, in use, the signals radiated by the radiators and reflected by the second portion of the reflector 11 obtained on the basis of the second portion 22 of the template 20 will be oriented in directions comprised between the direction identified by the predefined maximum angle of transmission $\theta_{max}$ and the nadir in accordance with the laws of geometrical or physical optics.

In particular, the second portion 22 of the template 20, in the plane XZ, extends laterally from the first point A up to a second point B set at a second distance $D_S$, in the direction X, from the first point A.

In addition, once again with reference to FIG. 2, the electronically steerable planar radiating array 13 conveniently has a rotational symmetry about the axis of symmetry 12, i.e., the axis Z, and extends, in the plane XZ, laterally from the axis of symmetry 12 for a distance $D_A/2$ in the direction X, whilst we have $D_F > D_A/2$. In other words, the second portion of the reflector 11 obtained on the basis of the second portion 22 of the template 20 extends outside the encumbrance $D_A/2$ of the electronically steerable planar radiating array 13 set in the focal plane in such a way as to prevent, in use, blocking of the signals reflected by the second portion of the reflector 11 by the electronically steerable planar radiating array 13.

Conveniently, the template 20 can be further shaped via standard techniques based upon physical optics in such a way as to obtain the distribution of power in the desired angular range in accordance with the isoflux distribution of the power desired on the Earth.

Figure 3:
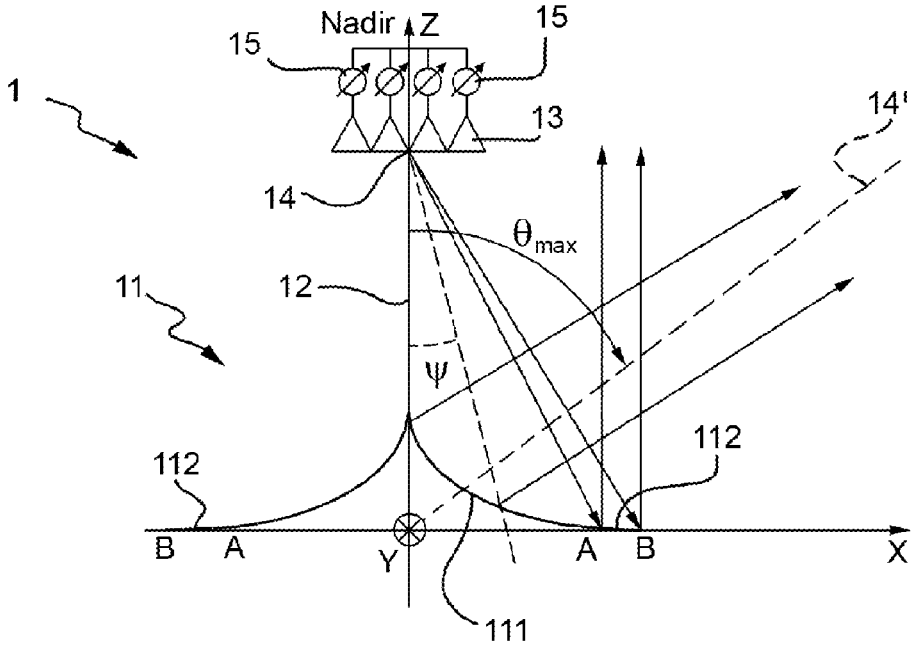
FIG. 3 is a schematic lateral sectional view of the final lateral profile of the reflector of the antenna system according to the first preferred embodiment of the present invention, where also schematically shown is a tracing in geometrical optics of the signals transmitted by the antenna system.

The reflector 11 is thus obtained by rotation through 360° about the axis of symmetry 12, i.e., the axis Z, of the template 20 thus obtaining the lateral analytical profile of the reflector 11 illustrated in FIG. 3, where the elements that are the same as the ones already described and illustrated in FIGS. 1 and 2 are identified by the same reference numbers. In other words, from a three-dimensional standpoint and with reference to FIG. 3, since the reflector 11 is obtained on the basis of the template 20 rotated through 360° about the axis of symmetry 12, i.e., the axis Z, it comprises:

a first portion, or focusing portion, 111 that
- extends about the axis of symmetry 12, i.e., the axis Z, namely, in use, the nadir;
- has a rotational symmetry about the axis of symmetry 12, i.e., the axis Z, namely, in use, the nadir;
- is configured to reflect the signals radiated by the radiators; and
- is shaped in such a way as to focus the reflected signals in first directions of transmission identified in space by the predefined maximum angle of transmission $\theta_{max}$ with respect to the axis of symmetry 12, namely, in use, the nadir axis, that angularly correspond to the maximum of the isoflux diagram desired in use with respect to the nadir axis 12; and a second portion 112 that
- extends around the focusing portion 111;
- has a rotational symmetry about the axis of symmetry 12, i.e., the axis Z, namely, in use, the nadir;
- is configured to reflect the signals radiated by the radiators; and
- is shaped in such a way as to direct the reflected signals gradually in second directions of transmission identified in space by angles with respect to the axis of symmetry 12, namely, in use, the nadir axis, that are comprised between 0° and $\theta_{max}$.

In addition, FIG. 3 also shows variable phase shifters 15 coupled to the radiators of the electronically steerable planar radiating array 13.

In particular, as illustrated in FIG. 3, by appropriately phasing the radiators via the variable phase shifters 15, it is possible to obtain in the plane XZ a primary antenna beam of a "gaussian" type with pointing, in the plane XZ, at an angle of illumination ψ from the axis Z, namely, in use, from the nadir axis 12, that identifies a direction of illumination halfway between the nadir axis 12 and the edge B of the reflector 11. In more rigorous terms, preferably the primary antenna beam, in use, in the antenna version with just one degree of freedom, is pointed in a direction of illumination identified by a bisectrix of an angle formed by the axis of symmetry 12 and by a direction that joins the electronically steerable planar radiating array 13 to the edge B of the reflector 11.

Figure 4:
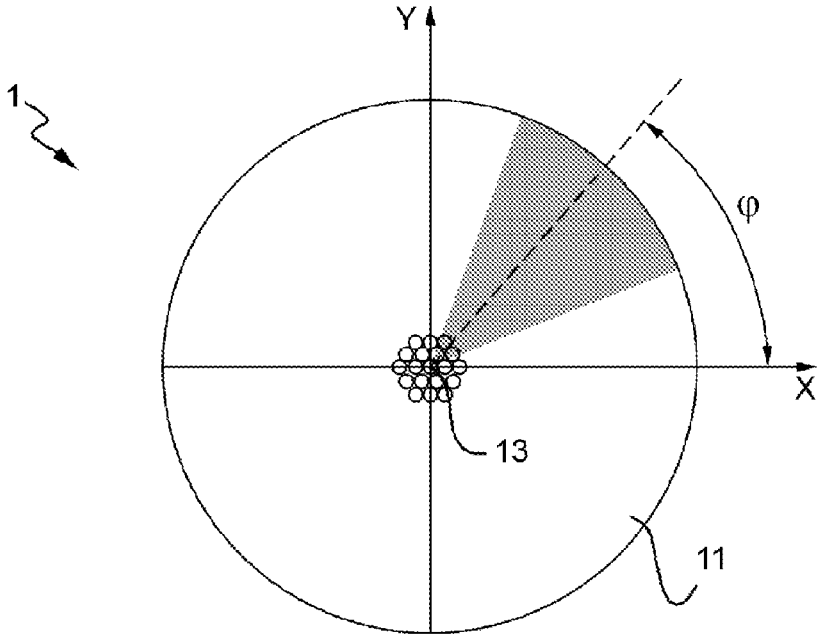
FIG. 4 is a schematic top plan view of the antenna system according to the first preferred embodiment of the present invention.

Moreover, said primary antenna beam, as illustrated in a top plan view of the antenna system 1 shown in FIG. 4, is sectorial in extension also in the plane XY, i.e., in ϕ, according to the beam width that can be obtained on the basis of the dimensions of the array 13 of the radiators set in the first focus 14. In use, after the primary antenna beam is reflected by the reflector 11, a secondary antenna beam is obtained, which has a peak in the direction identified by the predefined maximum angle of transmission $\theta_{max}$ with respect to the nadir 12 and that follows a decreasing profile of the gain, i.e., suited to achieving the isollux distribution of the power radiated up to the nadir direction 12. The secondary antenna beam has, instead, a beam width in ϕ, i.e., in the plane XY, that primarily depends upon the dimensions of the electronically steerable planar radiating array 13 in so far as the optics is not focusing in the plane XY since it has rotational symmetry with respect to the axis Z. By changing linearly the phasing of the radiators via the variable phase shifters 15 as a function of ϕ it is possible to generate a continuous rotation of the beam with respect to the nadir axis 12.

An alternative approach to obtain a more directive point-to-point beam consists, instead, in optimizing the profile, i.e., the shaping, of the reflector 11, which, in any case, always has rotational symmetry with respect to the nadir axis 12, by imposing simultaneously optimisation of the profile of the reflector 11 and of the law of phase offset of the electronically steerable planar radiating array 13 for a pre-determined number of directions in ψ of the primary antenna beam and in θ of the secondary antenna beam.

Figure 5:
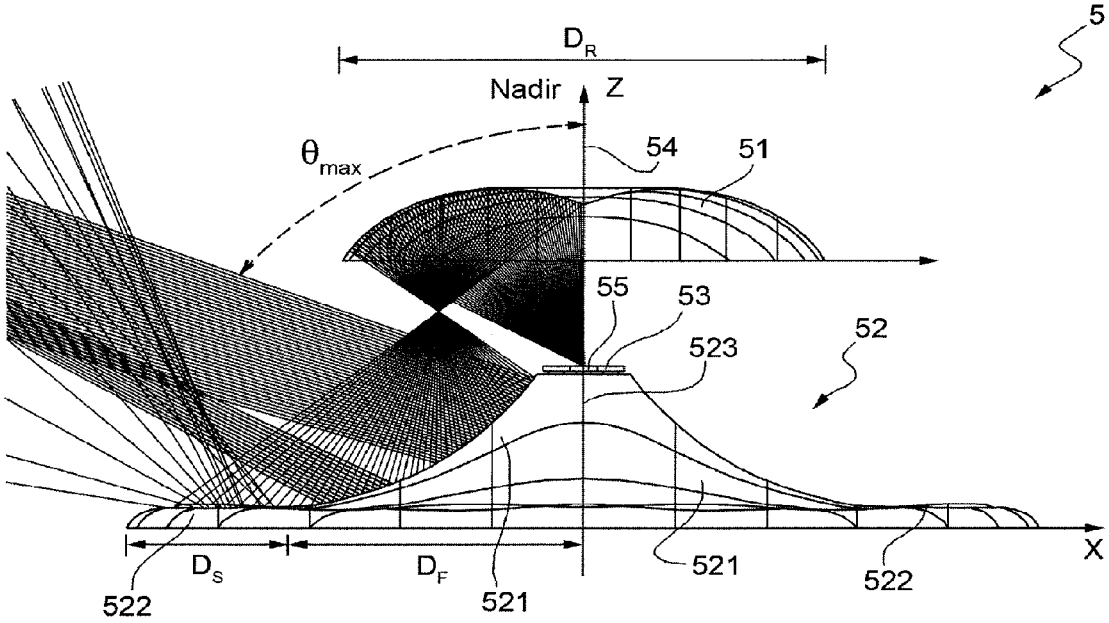
FIG. 5 is a schematic lateral sectional view of an antenna system according to a second preferred embodiment of the present invention, where also schematically shown is a tracing in geometrical optics of signals transmitted by the antenna system.

FIG. 5 is a schematic illustration of a cross section of an antenna system 5, obtained according to a second preferred embodiment of the present invention, together with a tracing in geometrical optics of signals transmitted by the antenna system 5.

In particular, as illustrated in FIG. 5, the antenna system 5, which is designed to be installed on a LEO satellite, comprises:

a first reflector, or sub-reflector, 51 with rotational symmetry with respect to an axis of symmetry 54 that, in use, coincides with the nadir of the antenna system 5 installed on the LEO satellite (not illustrated in FIG. 5), said sub-reflector 51 comprising a central portion (which also has rotational symmetry with respect to the axis of symmetry 54) that extends about the axis of symmetry 54, and a lateral portion (which also has rotational symmetry with respect to the axis of symmetry 54) that extends about the central portion;

a second reflector, or main reflector, 52 with rotational symmetry with respect to the axis of symmetry 54, said main reflector comprising a central portion 523 (which also has rotational symmetry with respect to the axis of symmetry 54) that extends about the axis of symmetry 54 and is set facing the central portion of the sub-reflector 51, a first portion, or focusing portion, 521 (which also has rotational symmetry with respect to the axis of symmetry 54) that extends around the central portion 523 and has a sub-portion set facing the side portion of the sub-reflector 51, and a second portion 522 (which also has rotational symmetry with respect to the axis of symmetry 54) that extends around the first portion 521; and an electronically steerable planar radiating array 53, which is mounted on, or above, or inside, or supported by, said central portion 523 of the main reflector 52 and is configured to illuminate the sub-reflector 51 by radiating signals, conveniently having frequencies belonging to the X band and/or to the Ka-band, in such a way that the radiated signals propagate as far as the sub-reflector 51 and are hence appropriately reflected by said sub-reflector 51, as will be described in detail hereinafter.

In detail, with reference to the cartesian reference plane XZ illustrated in FIG. 5 and having the axis Z coinciding, in use, with the nadir of the antenna system 5 installed on the LEO satellite, i.e., with the axis of symmetry 54, the sub-reflector 51 extends laterally from the axis Z, i.e., from the axis of symmetry 54, namely, in use, from the nadir, for a distance $D_R/2$ in the direction X, the focusing portion 521 of the main reflector 52 terminates at a distance $D_{F>DR}/2$, in the direction X, from the axis Z, i.e., from the axis of symmetry 54, namely, in use, from the nadir, and the second portion 522 of the main reflector 52 extends laterally from the focusing portion 521 for a distance $D_S$ in the direction X.

Entering into even greater detail, the sub-reflector 51 is configured to reflect the signals radiated by the radiators 53 and is shaped in such a way as to direct the signals reflected towards the first portion 521 and the second portion 522 of the main reflector 52.

Moreover, the first portion, or focusing portion, 521 of the main reflector 52 is configured to:

reflect the signals reflected by the sub-reflector 51; and focus the signals reflected in first directions of transmission identified in space by a predefined maximum angle of transmission $\theta_{max}$ with respect to the axis of symmetry 54, namely, in use, the nadir axis, which correspond angularly to the maximum of the isoflux diagram desired in use with respect to the nadir axis 54.

In turn, the second portion 522 of the main reflector 52 is configured to:

reflect the signals reflected by the sub-reflector 51; and gradually direct the signals reflected in second directions of transmission identified in space by angles with respect to the axis of symmetry 54, namely, in use, the nadir axis, that are comprised between 0° and $\theta_{max}$.

More specifically, since FIG. 5 illustrates a cross section of the antenna system 5, it shows the lateral profile of the reflectors 51 and 52 with rotational symmetry after shaping and the arrangement of the radiating elements with plane of aperture translated with respect to the primary antenna focus 55. In addition, FIG. 5 is a schematic illustration also of a trace of the signals that, in use, are radiated by the radiators, are reflected by the sub-reflector 51, and are then again reflected by the main reflector 52, in particular by the focusing portion 521 and by the second portion 522, in accordance with the desired power distribution. As illustrated in FIG. 5, the antenna system 5, and in particular the sub-reflector 51 and the main reflector 52, are configured in such a way that, in use, the signals reflected by the main reflector 52, in particular by the second portion 522 of the main reflector 52, are not blocked by the sub-reflector 51.

Preferably, the primary antenna beam radiated by the electronically steerable planar radiating array 53, in use, in the antenna version with just one degree of freedom, is pointed half-way between the axis of symmetry 54 and the edge of the sub-reflector 51, i.e., in more rigorous terms, in a direction of illumination identified by a bisectrix of an angle formed by the axis of symmetry 54 and by a direction that joins the planar array 53 to the edge of the sub-reflector 51.

The starting canonical optics for a double-reflector system can be for example constructed with reference to configurations known in the literature as "Axial Displaced Ellipse" (ADE) of first or second species. In this regard, reference may, for example, be made to F. J. S. Moreira, J. R. Bergmann, *Classical Axis-Displaced Dual-Reflector Antennas for Omnidirectional Coverage*, IEEE Transactions on Antennas and Propagation, Vol. 54, No. 10, October 2006.

As is known, an ADE antenna optics makes it possible to obtain from a fixed illuminator set in the antenna focus, for example the point 55 in FIG. 5, a secondary toroidal beam focusing in a direction $\theta_{max}$ the angular value and the peak gain of which can be parameterized on the basis of the geometrical parameters of the antenna optics (primary and secondary foci, profiles and diameters of the reflectors).

Consequently, the sub-reflector 51 and the main reflector 52 can, conveniently, be initially obtained starting from a canonical ADE double-reflector system. The final geometry of the reflectors may be obtained subsequently by adapting, i.e., extrapolating therefrom, the dimensions and optimizing the profiles, i.e., the shapings, thereof in a way similar to the construction of the reflector 11 described previously in relation to the single-reflector antenna system 1. The procedure of shaping and extrapolation of the main reflector will be dependent upon and functional to the law of illumination of the electronically steerable planar radiating array 53 in the proximity of the focal plane.

The double-reflector antenna system 5 is more practical, in terms of construction and installation on board a LEO satellite, as compared to the single-reflector antenna system 1. In fact, the double-reflector antenna system 5 avoids the burden of having to sustain and supply the array 13 of the radiators (and the respective phase shifters 15) arranged in the focal plane of the single reflector 11 of the antenna system 1.

Figure 6:
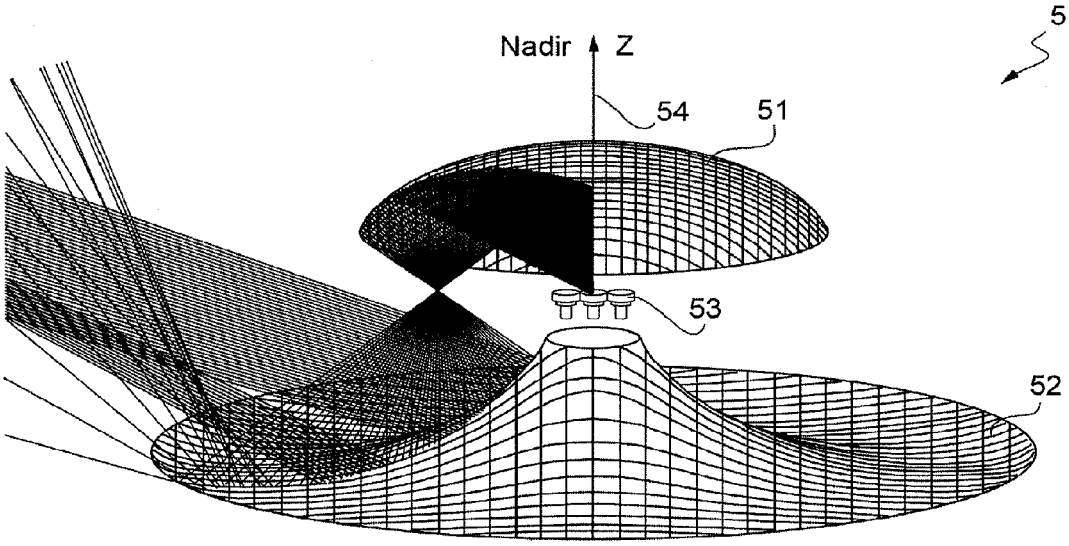
FIG. 6 is a schematic three-dimensional view of the antenna system according to the second preferred embodiment of the present invention.

FIG. 6 illustrates a three-dimensional view of the antenna system 5 in which the distribution of the signals radiated in use by the electronically steerable planar radiating array 53 and reflected by the sub-reflector 51 and by the main reflector 52 is illustrated with greater clarity.

Figure 7:
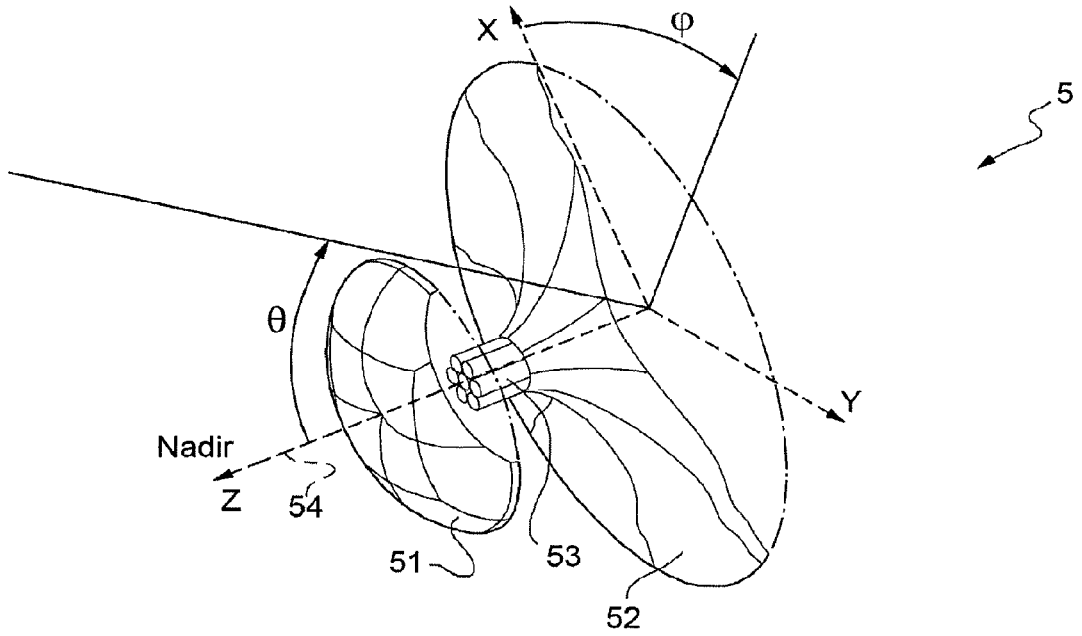
FIG. 7 is a perspective view, obtained by CAD (Computer-Aided Design), of the antenna system according to the second preferred embodiment of the present invention.

FIG. 7 is a perspective view, obtained by means of computer-aided design (CAD), of the double-reflector antenna system 5, where the planar array 53 in this case comprises seven radiators, together with the associated reference system in polar co-ordinates.

Figure 8:
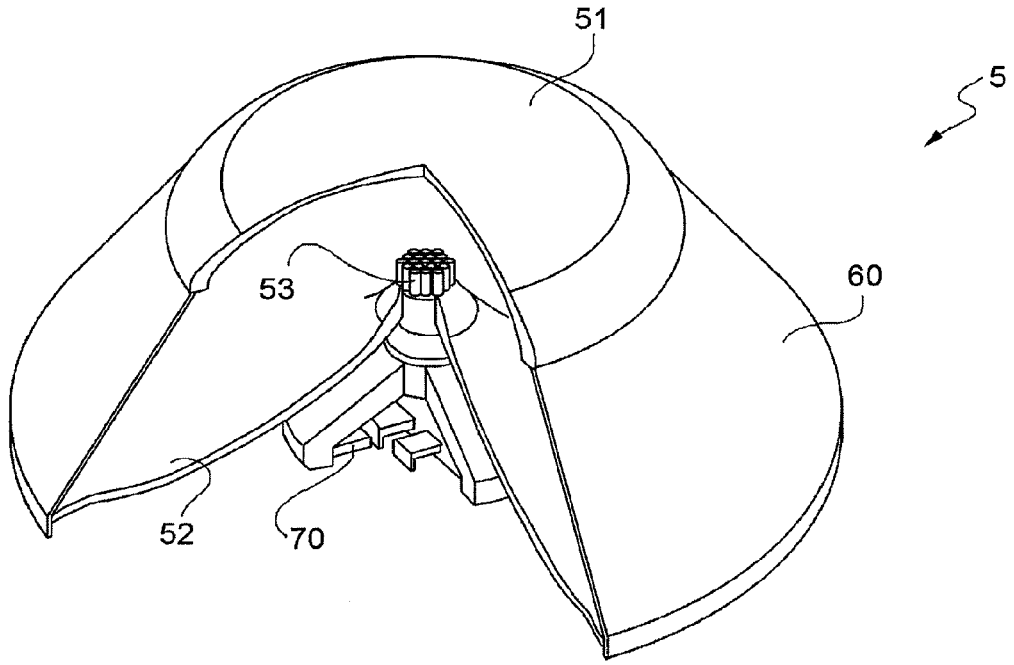
FIG. 8 is a three-dimensional perspective view, with parts removed for clarity, of the antenna system according to the second preferred embodiment of the present invention that moreover comprises a radome.
Figure 9:
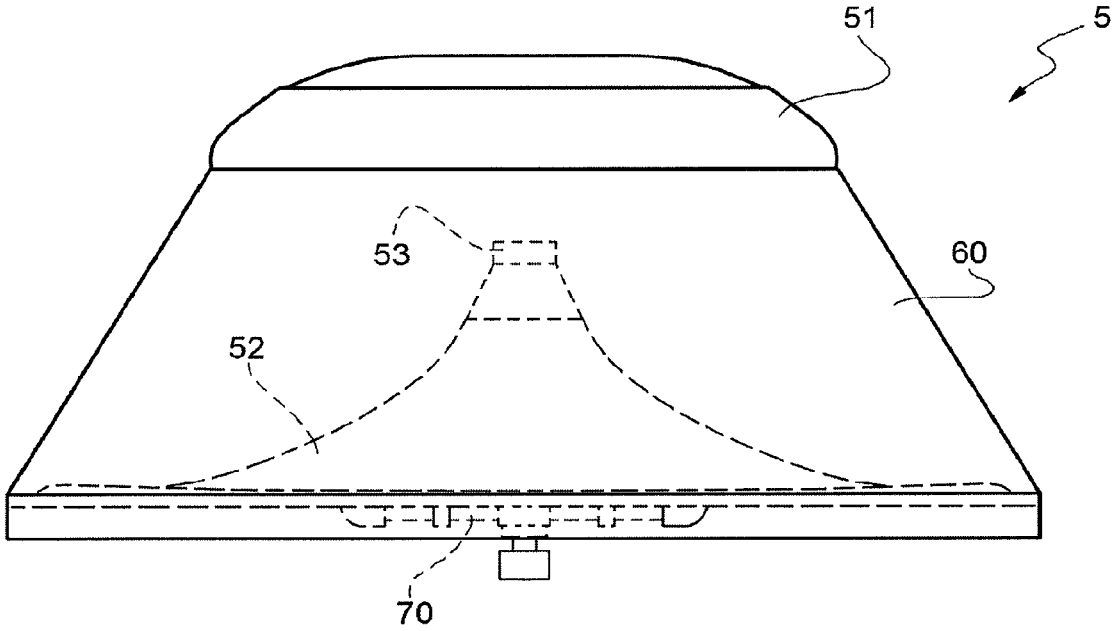
FIG. 9 is a side view, with parts in see-through view, of the antenna system of FIG. 8.

In addition, FIGS. 8 and 9 illustrate a preferred embodiment of the antenna system 5 that envisages a truncated cone, or radome, 60 of dielectric material, which supports the sub-reflector 51 and housed inside which is the main reflector 52 and the electronically steerable planar radiating array 53. In particular, FIG. 8 is a three-dimensional perspective view, with parts removed for clarity, of the antenna system 5 comprising the truncated cone 60, and FIG. 9 is a side view, with parts in see-through view, of the antenna system 5 comprising the truncated cone 60. In addition, in FIGS. 8 and 9 also a power-supply network 70 is illustrated coupled to the electronically steerable planar radiating array 53 and operable to drive appropriately said planar array 53.

Figure 10:
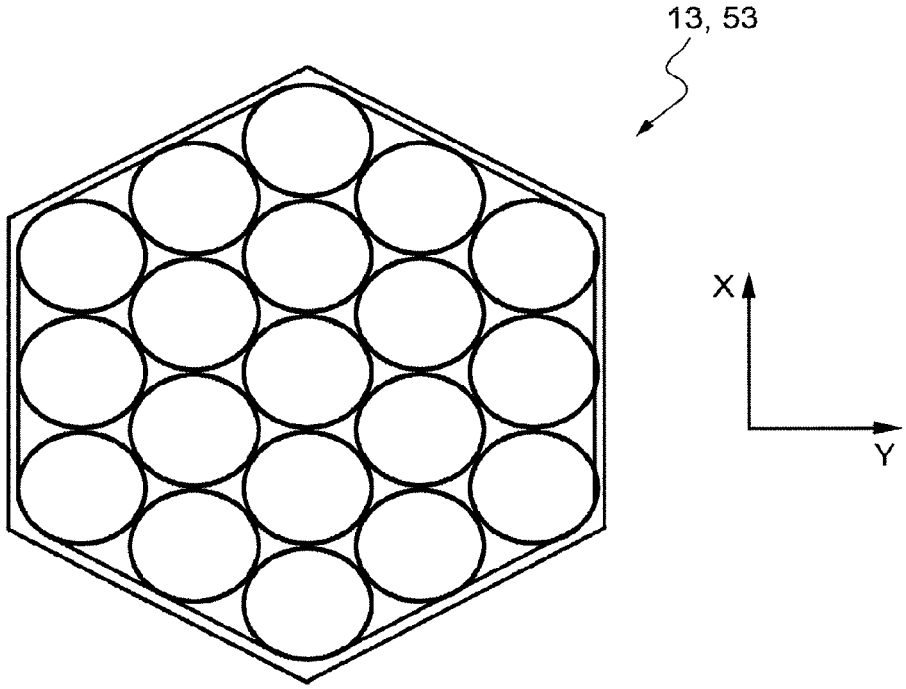
FIGS. 10 and 11 are schematic illustrations of two preferred arrangements of radiating elements of the antenna system according to the present invention.
Figure 11:
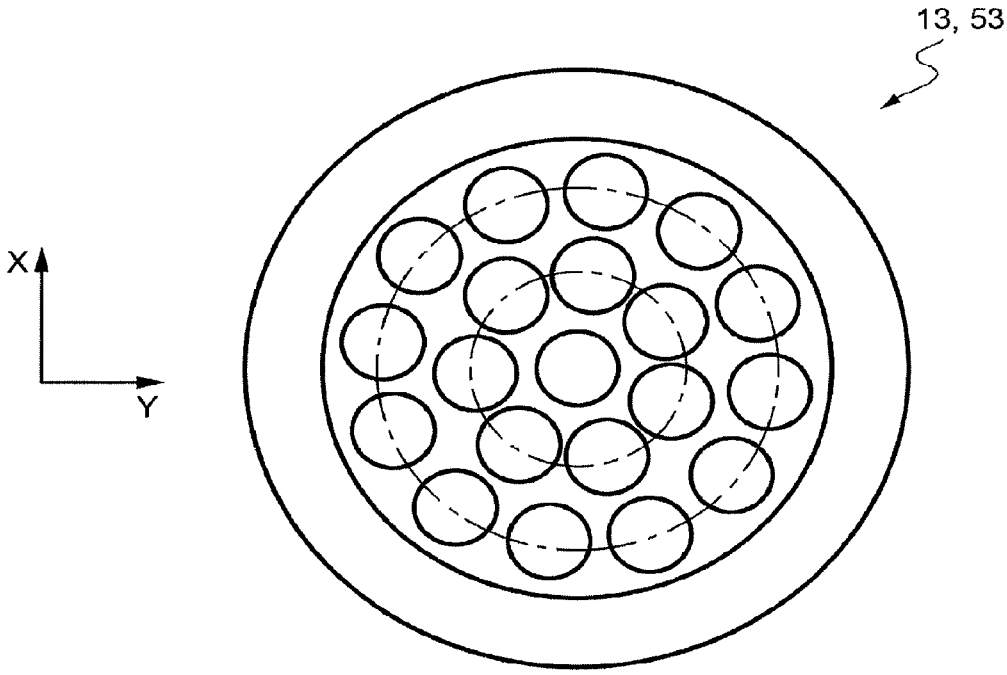

On the other hand, FIGS. 10 and 11 illustrate two possible arrangements for the radiating elements of the electronically steerable planar radiating arrays 13 and 53 set, respectively, in the antenna focal plane 14 and 55. In particular, FIG. 10 illustrates an arrangement of the radiating elements with equilateral triangular mesh, whilst FIG. 11 shows a distribution of the radiating elements set at equiangular distances apart on circumferences of different diameters, i.e., a distribution with equidistant pitch of the radiating elements arranged on circumferences of different diameters.

Figure 12:
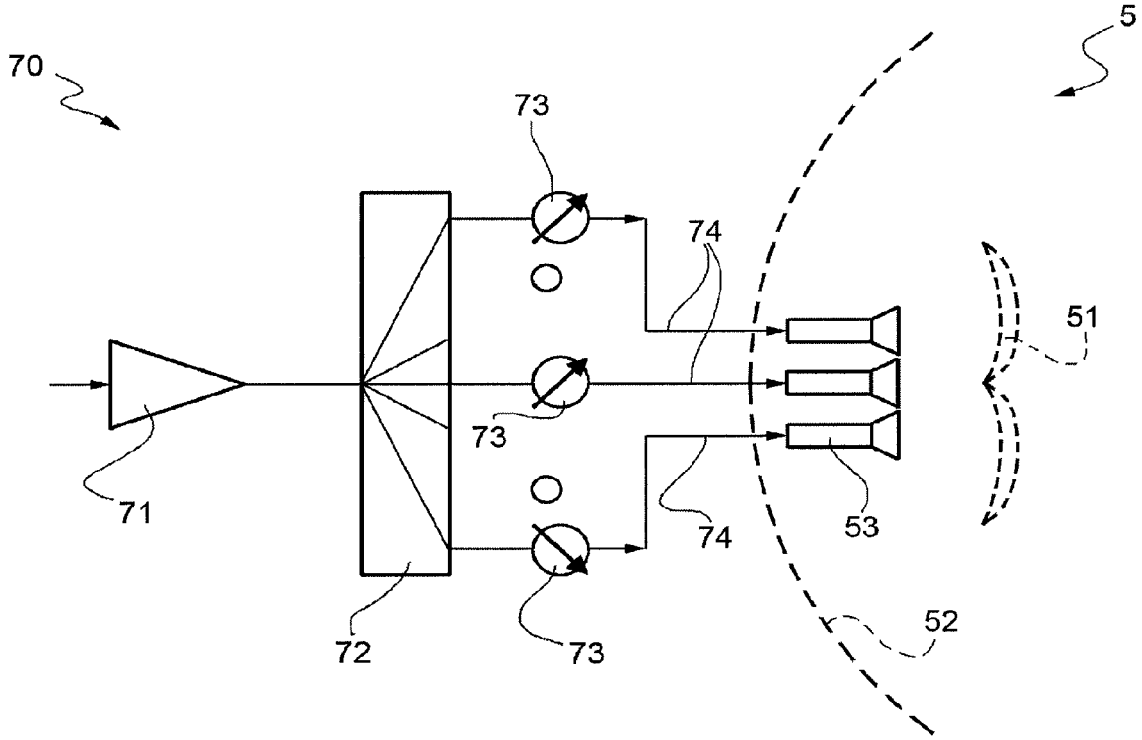
FIG. 12 is a schematic illustration of a passive supply architecture for the antenna system according to the second preferred embodiment of the present invention.

In addition, as regards the power-supply network 70, different schemes are possible. In this regard, FIG. 12 illustrates a block diagram of the antenna system 5 based upon a passive supply architecture. In particular, as illustrated in FIG. 12, the power-supply network 70, in this case passive, comprises a power amplifier 71 connected in cascaded fashion to a passive beam-forming network 72 connected at output to variable power phase shifters 73, for example with ferrite, which can be controlled electronically and coupled to the electronically steerable planar radiating array 53 by means of waveguides and/or RF cables 74. As described previously, in use, the electronically steerable planar radiating array 53 radiates a primary beam towards half of the sub-reflector 51, which reflects the energy towards the main reflector 52, which re-radiates the beam in far field. In the embodiment of the power-supply network 70 illustrated in FIG. 12, the amplification scheme of the antenna system 5 is of a centralized type because it comprises just one amplifier provided at input to the power-supply network 70.

Figure 13:
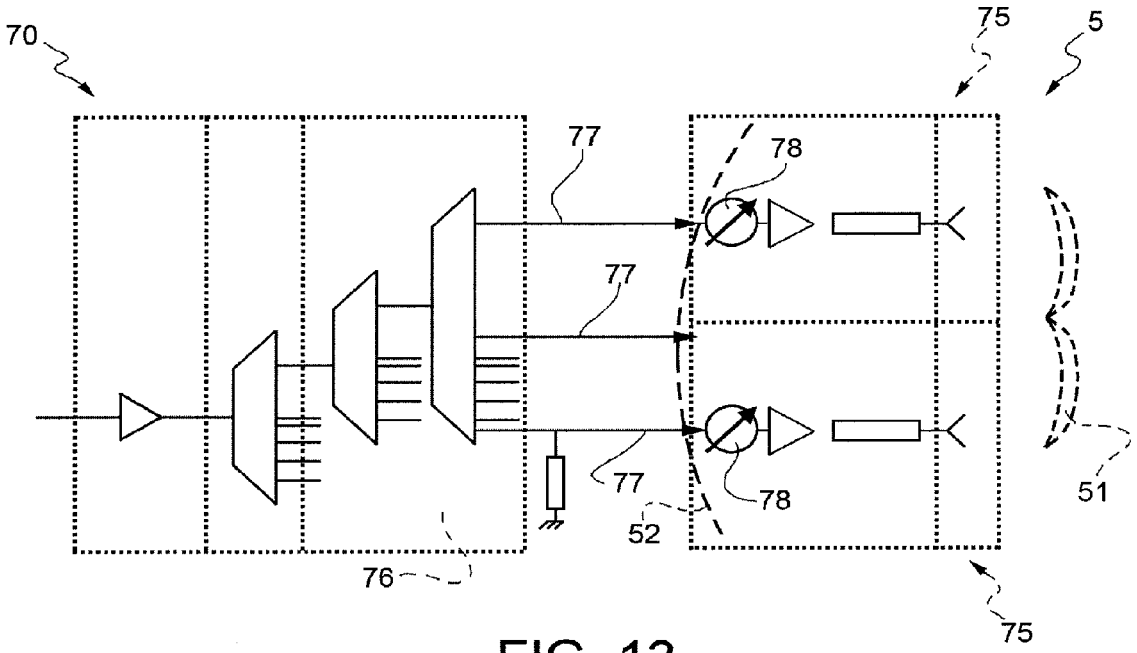
FIG. 13 is a schematic illustration of an active supply architecture with distributed amplification for the antenna system according to the second preferred embodiment of the present invention.

FIG. 13 illustrates, instead, a block diagram of the antenna system 5 based upon an active supply architecture with distributed amplification via the use of solid-state modules 75 that form an integral part of the illuminator of the antenna system 5, i.e., of the electronically steerable planar radiating array 53. In particular, in the embodiment illustrated in FIG. 13, since the power-supply network 70 comprises a passive network of dividers 76 and cables 77, it presents low power with even high losses. The control of the phases, in this embodiment, can conveniently be obtained directly at the level of the active modules 75 via, for example, multi-bit phase shifters 78 obtained on the basis of monolithic microwaves integrated circuits (MMICs) and included in the active modules 75. Alternatively, in the active supply architecture, the variable phase shifters can be conveniently replaced by a given number of passive RF distribution networks that form a given number of fixed beams (multi-beam antenna).

On the other hand, the antenna system 5 can conveniently have also a hybrid supply architecture in which a few medium-power amplifiers are set at an intermediate level between the input and the radiating elements.

Moreover, the passive, active, or hybrid supply architectures described previously can conveniently be applied also to the single-reflector antenna system 1.

Figure 14:
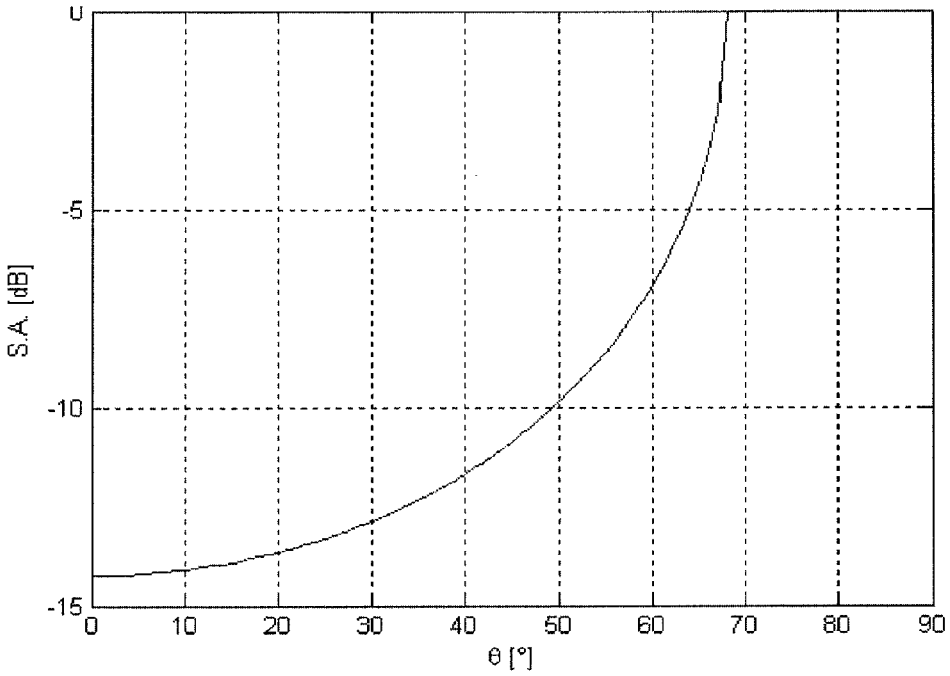
FIG. 14 illustrates the typical gain mask as a function of the angle with respect to the nadir required of an antenna installed on board a LEO satellite orbiting at a height of 500 km from the Earth.

Finally, FIG. 14 shows, purely by way of illustration, a typical example of mask of radiation diagram designed to achieve an isoflux distribution of the power for an antenna installed on board a LEO satellite orbiting at a height H=500 km from the Earth, i.e., designed to compensate for the difference of spatial attenuation according to the following equation (Eq. 1)

$$S.A.(\mathrm{dB}) = 20*\log 10(r/H) = 20*\log 10\frac{[(H+R)*\cos(E_1+\vartheta)]}{[H*\cos(E_1)]}$$

where

S.A. (dB) is the difference of spatial attenuation in dB between the generic direction r of radiation from the satellite and the direction of the nadir;

H is the satellite-Earth distance at the nadir, i.e., the height of the orbit of the satellite;

R is the radius of the Earth that is assumed as being equal to 6378 km;

El is the angle of elevation of the receiving Earth station towards the satellite (to obtain the diagram of FIG. 14, $El_{min}=0°$ has been assumed as corresponding to the Earth's edge); and θ is the angle between the nadir axis of the satellite and the direction that joins the receiving Earth station with the satellite.

To sum up, with reference to FIGS. 5-14 described previously, the double-reflector antenna system 5 presents the following characteristics:

the shaped double-reflector optical system, with rotational symmetry, comprising the sub-reflector 51 and the main reflector 52, and, in use, illuminated by the electronically steerable planar radiating array 53 in which the electronic beam can be scanned via the variable phase shifters 73 or 78 set behind the radiating elements;

the profiles of the reflectors 51 and 52 such as to convert, in use, by means of reflection, the electromagnetic wave generated by the electronically steerable planar radiating array 53 in a secondary diagram with distribution of the gain in accordance with Eq. 1, i.e., such as to obtain a constant distribution of the power radiated to the Earth according to the height of the orbit of the LEO satellite on which, in use, the antenna system 5 is installed, for example as illustrated in FIG. 14;

the electronically steerable planar radiating array 53 that, in use, radiates, in the antenna version with just one degree of freedom, a primary beam with constant inclination along an axis ψ half-way between the edge of the sub-reflector 51 and its centre (coinciding with the axis of symmetry 54), whilst the phase of the radiators can be varied continuously and linearly in ϕ in such a way as to obtain a beam with continuous electronic scanning with respect to the nadir axis 54;

the electronically steerable planar radiating array 53 set in the focal plane, which has small dimensions because, typically, it can comprise between seven and thirty-seven radiating elements;

the radiating elements set, preferably, to form an equilateral triangular mesh, or else with regular spacing on circumferences of different diameters, as illustrated in FIGS. 10 and 11, in such a way as to guarantee a beam with rotational symmetry in cp with respect to the nadir axis 54; and the support of the sub-reflector obtained preferably with a thin dielectric radome 60, as illustrated in FIGS. 8 and 9, such as to minimize, in use, the effect of blocking of the signals reflected by the main reflector 52; alternatively, the support of the sub-reflector 51 could be obtained via an alternative system, for example based upon low-RF-reflecting supports.

On the other hand, in a more advanced embodiment of the antenna system 5, the profile of the reflectors 51 and 52 and the electronic scanning at a primary level could conveniently be defined on the basis of a combined process of synthesis aimed at obtaining an electronic beam with scanning capacity that is discrete in θ and continuous in ϕ.

In practice, the antenna system according to the present invention comprises an electronically steerable planar radiating array magnified by an antenna optics comprising one or two reflectors with rotational symmetry, the profile of which is optimised for distributing the power on the Earth with isoflux characteristics (i.e., with distribution of gain in accordance with Eq. 1). Moreover, by changing the law of the phase shifters that drive the radiating elements of the electronically steerable planar radiating array, the antenna system can obtain an isoflux electronic beam rotating about the nadir axis (repointing with one degree of freedom). In a more complex version, the antenna system also enables a discrete repointing in elevation, i.e., with two degrees of freedom.

From the foregoing description the advantages of the present invention may be immediately understood.

In particular, the antenna system according to the present invention constitutes an effective solution to the problems described previously in relation to known antenna systems, since it yields, even in a minimal embodiment, an isoflux beam with electronic scanning with just one degree of freedom (i.e., about the nadir axis), the constant EIRP of which can be obtained at different absolute levels by changing the dimensions of the reflectors and/or the number of the radiating elements or else the power thereof.

In detail, the antenna architecture according to the present invention combines the advantages typical of electronically steerable planar radiating arrays, such as flexibility of point-to-point connection, no mechanical movement, and scanning speed, to those of reflector antennas that typically present a lower cost and prove particularly advantageous in the case where the beams require focusing apertures of various wavelengths. More specifically, the antenna architecture described previously, thanks to the considerable flexibility of implementation that characterizes it, enables different architectural solutions to be obtained based upon different technological solutions compatible with diversified costs and performance.

In even greater detail, it is possible to summarize the following advantages of the present invention over the solutions currently available and/or appearing in the literature:

1) the antenna system according to the present invention can be sized in such a way as to achieve different values of gain with constant distribution of the power on the Earth; in particular, this characteristic can be obtained by increasing the dimensions of the reflectors of the antenna optics (in fact the antenna gain and the beam width with respect to θ vary roughly linearly as a function of the dimensions of the single reflector 11 or of the main reflector 52), and/or by increasing the number of radiating elements (in fact, the antenna gain and the beam width in ϕ vary linearly as a function of the dimensions of the array 13 or 53 of the radiators in the focal plane); moreover, the EIRP for architectural solutions with distributed amplification can be increased also on the basis of the number of the active modules 75 and of the power of the individual active module 75;

2) the antenna system according to the present invention eliminates the limitations intrinsic of the solutions with direct active array, which do not enable handling of satellites in very low orbit (for example <1000 km) because they are typically limited in scanning to 60° from the nadir; moreover, direct planar arrays present a high gain at the nadir, where on the other hand a very low gain is required, whereas, at the maximum scanning range, where a higher gain would be required (for example, in the region of 12-15 dB), they yield a lower gain, in accordance with at least the scanning factor cos θ; instead, the antenna system according to the present invention, can be designed to work with satellites very close to the Earth (for example, in the limit, at an altitude close to 0 km, i.e., with $\theta_{max}$=90° with zero scanning losses, where, for example solutions with direct planar array suffer markedly from these limits; in particular, this characteristic can be obtained by working on the parameters of the starting optical reflection system and on the profiles of the reflectors 11, 51 and 52;

3) the number of elements of the array 13 or 53 can be small, typically contained in a range of 7-37 radiating elements; on the other hand, for example, solutions with direct active array require a much higher number of radiating elements; this characteristic enables a considerable architectural simplification and a reduction in costs;

4) the antenna system according to the present invention is potentially compatible with solutions for re-use of the spectrum by discrimination of polarisation, since it is possible to minimize the crossed polarisation via control of the rotation of the elements and of the excitation phases (known in the literature as "sequential rotation");

5) the architecture of the antenna system according to the present invention can be passive, for example based upon centralized amplification and medium-power phase shifters, or else semi-active, for example based upon a restricted number of amplifiers distributed in intermediate positions between the radiating elements and the antenna input, or else active with high integration, with the amplifiers and phase shifters integrated directly behind the radiating elements; this characteristic enables a plurality of EIRPs and overall dimensions to be obtained as a function of the dimensions and of the technologies available;

6) according to a preferred embodiment, the antenna system yields a beam isoflux in θ avoiding the burden of having to vary dynamically the power radiated on the Earth as a function of the user's position, as occurs, for example, in antenna solutions with mechanically scanned beam, or else in direct-planar-array solutions with electronically scanned beam;

7) in a very simple preferred embodiment, the antenna system envisages electronic scanning with just one degree of freedom (rotation of the isoflux beam about the nadir); consequently, the logic of pointing of the beam in orbit towards the Earth station proves simple (in fact, just the knowledge of the angle ϕ comprised between the equator and the plane that passes through the nadir and the Earth station to be reached is required); and 8) in a more complex preferred embodiment, the antenna system can be configured in such a way as to handle also a scanning in θ, in addition to a scanning in ϕ, thus enabling a further control of the gain and of the antenna beam as a function of the point to be reached.

On the other hand, the antenna system according to the present invention could find use also on LEO satellites for telecommunications that require a limited number of beams that are fixed or repointable on the Earth.

Finally, it is clear that various modifications may be made to the present invention, all of which fall within the sphere of protection of the invention, as defined in the annexed claims.

The invention claimed is:

1. An antenna system, comprising:

a reflection system that comprises a reflector having a rotational symmetry with respect to an axis of symmetry; and an electronically steerable planar radiating array having a rotational symmetry with respect to the axis of symmetry, the electronically steerable planar radiating array being arranged in a focal region of the reflection system, wherein a primary radiofrequency beam, oriented in a predefined direction of illumination with respect to the axis of symmetry, radiates towards the reflection system from the electronically steerable planar radiating array and is reflected by the reflection system such that the reflector generates a secondary radiofrequency beam that is transmitted away from the reflector, wherein a region of the reflector is shaped to transmit the secondary radiofrequency beam by reflection in a plurality of directions according to an isoflux distribution that extends from, and is inclusive of, an angle of zero degrees relative to the axis of symmetry to a non-zero maximum angle of transmission relative to the axis of symmetry, wherein at least one of a shape or a size of the region of the reflector prevents transmission of the isoflux distribution of the secondary radiofrequency beam by the reflector from being blocked by the antenna system; and wherein the region of the reflector comprises (i) a first portion that is shaped to direct the secondary radiofrequency beam in first predefined directions of transmission at the non-zero maximum angle of transmission; and (ii) a second portion that extends around the first portion of the reflector and is to direct the secondary radiofrequency beam in second predetermined directions of transmission between the angle of zero degrees and the non-zero maximum angle of transmission as well as at the angle of zero degrees.

2. The antenna system of claim 1, wherein the region of the reflector is designed so that the isoflux distribution of power transmitted for the secondary radiofrequency beam results at a given distance from the antenna system.

3. The antenna system of claim 1 wherein the reflection system is a single-reflector system including the reflector, and wherein the reflector and the electronically steerable planar radiating array are arranged in such a way as to cause the electronically steerable planar radiating array to directly illuminate the region of the reflector with the primary radio frequency beam.

4. The antenna system of claim 3, wherein the electronically steerable planar radiating array extends laterally from the axis of symmetry up to a first distance; and wherein the first portion of the single reflector extends laterally from the axis of symmetry up to a second distance greater than the first distance.

5. The antenna system of claim 3, wherein the electronically steerable planar radiating array is operable to radiate the primary radiofrequency beam of a gaussian type directed towards a central region of the region of the reflector.

6. The antenna system of claim 1, wherein the reflection system is a double-reflector system that comprises a sub-reflector having a rotational symmetry with respect to the axis of symmetry; and wherein the double-reflector system and the electronically steerable planar radiating array are arranged in such a way as to cause the electronically steerable planar radiating array to indirectly illuminate via the sub-reflector, the region of the reflector with the primary radio frequency beam.

7. The antenna system of claim 6, wherein the sub-reflector extends laterally from the axis of symmetry up to a first distance; wherein the reflector also comprises a central portion that is arranged about the axis of symmetry and supports the electronically steerable planar radiating array; and wherein the first portion of the reflector extends around said central portion of the reflector and up to a second distance from the axis of symmetry, said second distance being greater than the first distance.

8. The antenna system of claim 6, wherein the electronically steerable planar radiating array is operable to orient the primary radiofrequency beam in such a way as to illuminate directly a region of the sub-reflector that is designed, when illuminated by said primary radiofrequency beam, to reflect said primary radiofrequency beam in such a way as to illuminate directly the region of the reflector with the reflected primary radiofrequency beam.

9. The antenna system of claim 6, further comprising a radome of dielectric material that supports the sub-reflector; and wherein the reflector is housed within said radome.

10. The antenna system of claim 1, wherein the electronically steerable planar radiating array comprises radiating elements arranged according to an equilateral triangular mesh centered on the axis of symmetry and defining a plurality of radiating elements arranged in equilateral triangle configurations.

11. The antenna system of claim 1, wherein the electronically steerable planar radiating array comprises radiating elements arranged along circumferences of different diameters centered with respect to the axis of symmetry and set at equiangular distances apart on the respective circumferences relative to the axis of symmetry, each radiant element being equidistant from the adjacent radiating elements arranged along the same circumference as the one along which said radiant element is arranged.

12. The antenna system of claim 1, further comprising a power-supply network that is coupled to the electronically steerable planar radiating array and is operable to cause said electronically steerable planar radiating array to radiate the primary radiofrequency beam.

13. A payload data handling and transmission system for a satellite, comprising:

an antenna system disposed within the satellite, the antenna system comprising:

a reflection system that comprises a reflector having a rotational symmetry with respect to an axis of symmetry; and an electronically steerable planar radiating array having a rotational symmetry with respect to the axis of symmetry, the electronically steerable planar radiating array being arranged in a focal region of the reflection system, wherein a primary radiofrequency beam oriented in a predefined direction of illumination with respect to the axis of symmetry, radiates towards the reflection system from the electronically steerable planar radiating array and is reflected by the reflection system such that the reflector generates a secondary radiofrequency beam that is transmitted away from the reflector, wherein a region of the reflector is shaped to transmit the secondary radiofrequency beam by reflection in multiple directions according to an isoflux distribution that extends from, and is inclusive of, an angle of zero degrees relative to the axis of symmetry to a non-zero maximum angle of transmission relative to the axis of symmetry, wherein at least one of a shape or a size of the region of the reflector prevents transmission of the isoflux distribution of the secondary radiofrequency beam by the reflector from being blocked by the antenna system; and wherein the region of the reflector comprises (i) a first portion that is shaped to direct the secondary radiofrequency beam in first predefined directions of transmission at the non-zero maximum angle of transmission; and (ii) a second portion that extends around the first portion of the reflector and is to direct the secondary radiofrequency beam in second predetermined directions of transmission between the angle of zero degrees and the non-zero maximum angle of transmission as well as at the angle of zero degrees.

14. A satellite, comprising:

an antenna system, the antenna system comprising:

a reflection system that comprises a reflector having a rotational symmetry with respect to an axis of symmetry; and an electronically steerable planar radiating array having a rotational symmetry with respect to the axis of symmetry, the electronically steerable planar radiating array being arranged in a focal region of the reflection system, wherein a primary radiofrequency beam oriented in a predefined direction of illumination with respect to the axis of symmetry, radiates towards the reflection system from the electronically steerable planar radiating array and is reflected by the reflection system such that the reflector generates a secondary radiofrequency beam that is transmitted away from the reflector, wherein a region of the reflector is shaped to transmit the secondary radiofrequency beam by reflection in multiple directions according to an isoflux distribution that extends from, and is inclusive of, an angle of zero degrees relative to the axis of symmetry to a non-zero maximum angle of transmission relative to the axis of symmetry, wherein at least one of a shape or a size of the region of the reflector prevents transmission of the isoflux distribution of the secondary radiofrequency beam by the reflector from being blocked by the antenna system; and wherein the region of the reflector comprises (i) a first portion that is shaped to direct the secondary radiofrequency beam in first predefined directions of transmission at the non-zero maximum angle of transmission; and (ii) a second portion that extends around the first portion of the reflector and is to direct the secondary radiofrequency beam in second predetermined directions of transmission between the angle of zero degrees and the non-zero maximum angle of transmission as well as at the angle of zero degrees.

15. An antenna system, comprising:

an electronically steerable planar radiating array disposed coaxially with respect to an axis of symmetry, the electronically steerable planar radiating array being configured to transmit a primary radiofrequency beam; and a reflection system that comprises a reflector disposed coaxially with respect to the axis of symmetry, the reflector being positioned to, directly or indirectly, receive the primary radiofrequency beam and to generate a secondary radiofrequency beam by reflecting the primary radiofrequency beam reflect, wherein the reflector is shaped to reflect the secondary radiofrequency beam away from the reflector in a plurality of directions according to an isoflux distribution that extends from, and is inclusive of, an angle of zero degrees relative to the axis of symmetry to a non-zero maximum angle of transmission relative to the axis of symmetry; and wherein the reflector comprises (i) a first portion that is shaped to focus the primary radiofrequency beam in first transmission directions corresponding to the non-zero maximum transmission angle; and (ii) a second portion that is shaped to extend laterally from the first portion according to gradually modified radius of curvature to transmit the secondary radiofrequency beams in second transmission directions identified by angles between an angle of zero degrees and the non-zero maximum angle and in third transmission directions at the angle equal to zero degrees.

16. The antenna system of claim 15, wherein at least one of a shape or a size reflector prevents transmission the secondary radiofrequency beam by the reflector at the angle of zero degrees from being blocked by the antenna system.

17. The antenna system of claim 15, wherein the reflection system is a single-reflector system and the reflector is offset from the electronically steerable planar radiating array along the axis of symmetry, and wherein the reflector directly receiving the primary radiofrequency beam from the electronically steerable planar radiating array, and the second portion of the reflector extends laterally beyond an encumbrance of the electronically steerable planar radiating array to prevent transmission of the secondary radiofrequency beams at the angle of zero from being blocking by the array.

18. The antenna system of claim 15, wherein the reflection system is a double-reflector system and the reflector indirectly receives the primary radiofrequency beam from the electronically steerable planar radiating array after the primary radiofrequency beam is reflected by a sub-reflector, and wherein the second portion of the reflector extends laterally beyond an encumbrance of the sub-reflector to prevent transmission of the secondary radiofrequency beams at the angle of zero from being blocking by the sub-reflector.

* * * * *